US005209548A

United States Patent [19]

Locher

[11] Patent Number: 5,209,548

[45] Date of Patent: May 11, 1993

[54] CHAIR, IN PARTICULAR OFFICE CHAIR

[75] Inventor: Hermann Locher, Dornach, Switzerland

[73] Assignee: Giroflex Entwicklungs AG, Koblenz, Switzerland

[21] Appl. No.: 792,118

[22] Filed: Nov. 14, 1991

[30] Foreign Application Priority Data

Nov. 14, 1990 [CH] Switzerland ..... 03620/90

[51] Int. Cl.[5] ..... A47C 3/00

[52] U.S. Cl. ..... 297/301; 297/304

[58] Field of Search ..... 297/306, 307, 309, 304, 297/301, 316, 317, 320, 321, 322, 340–342, 354; 248/608, 609

[56] References Cited

U.S. PATENT DOCUMENTS

| | | | |
|---|---|---|---|
| 3,386,770 | 6/1968 | Williams | 297/304 |
| 4,652,050 | 3/1987 | Stevens | 297/304 X |
| 4,666,121 | 5/1987 | Choong et al. | 297/304 X |
| 4,865,384 | 9/1989 | Desanta | 297/304 |
| 4,979,778 | 12/1990 | Shields | 297/301 |

FOREIGN PATENT DOCUMENTS

| | | | |
|---|---|---|---|
| 282928 | 12/1965 | Australia | 248/608 |
| 0135875 | 4/1985 | European Pat. Off. . | |
| 309804 | 4/1989 | European Pat. Off. | 297/304 |
| 3322450 | 1/1985 | Fed. Rep. of Germany . | |
| 3619928 | 12/1987 | Fed. Rep. of Germany | 297/301 |
| 8806835 | 10/1988 | Fed. Rep. of Germany . | |
| 3719784 | 12/1988 | Fed. Rep. of Germany . | |

*Primary Examiner*—Laurie K. Cranmer
*Attorney, Agent, or Firm*—Egli International

[57] ABSTRACT

There is proposed a chair, particularly an office chair, of adjustable height and inclination which has a seat support (75), a backrest support (80), a standing column (10) with first gas spring (20) arranged therein, a support member (25) arranged in horizontal plane on the standing column (10), and a first guide rod (65) and a second guide rod (70). The second guide rod (70) is mounted with two struts laterally on the support member (25) and is functionally connected with a transmission mechanism.

The transmission mechanism arranged in the support member (25) is developed as an angular gearing which transmits the swinging movement of the second guide rod (70) which is oriented in the direction of the arrow B', on the one hand, by correspondingly arranged swing levers (62, 62') to a second gas spring (60) which is spaced from and parallel to the support member (25) and, on the other hand, via a tensioning device arranged in the support member (25), to the gas spring (20) which is arranged in the standing column (10).

13 Claims, 5 Drawing Sheets

FIG. 7
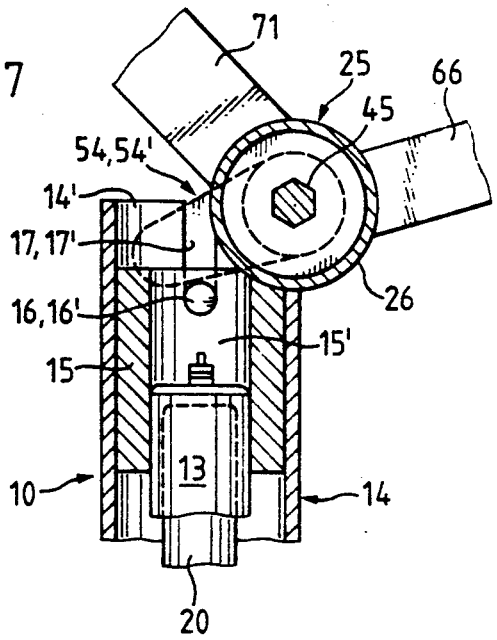
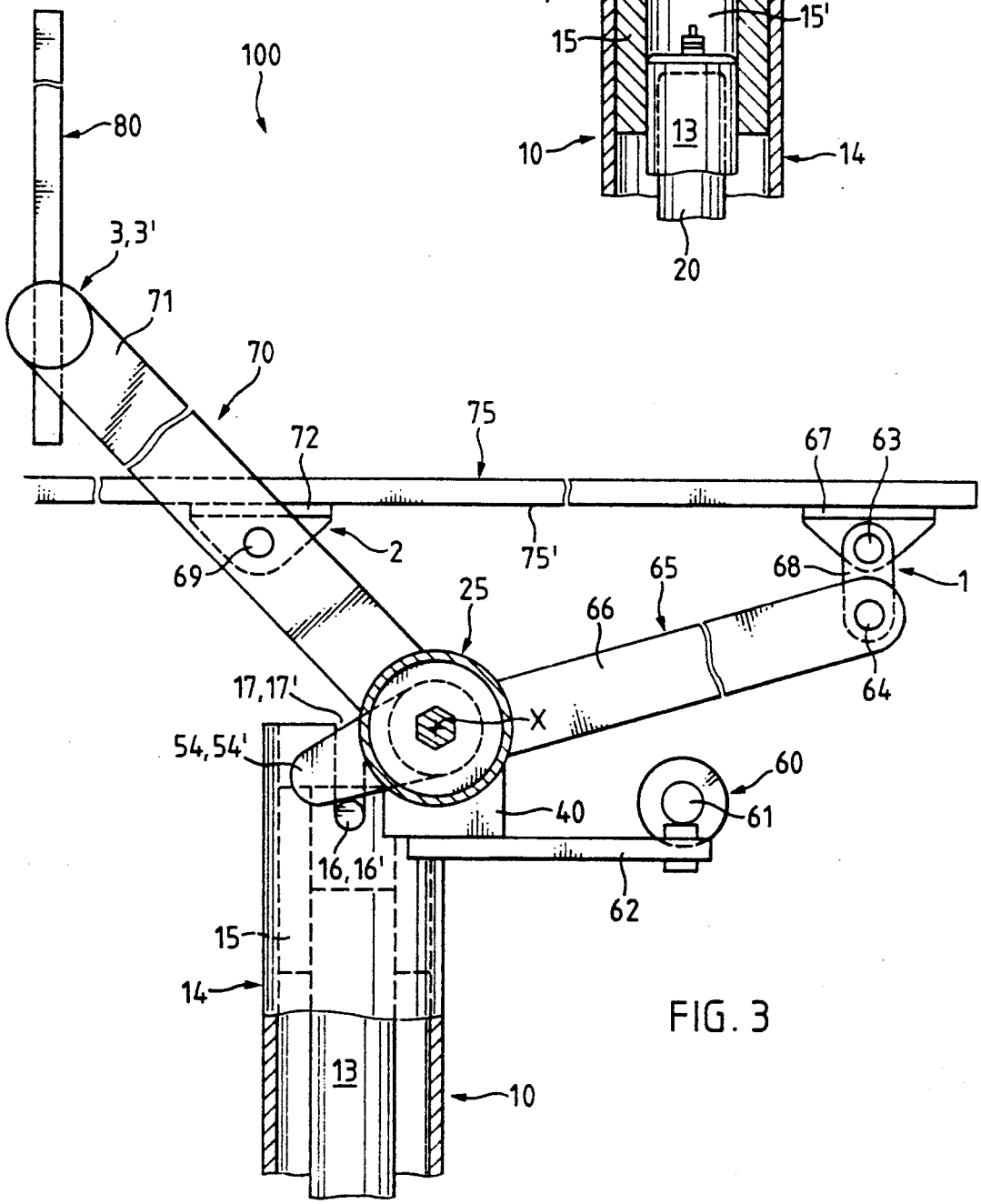
FIG. 3

CHAIR, IN PARTICULAR OFFICE CHAIR

BACKGROUND OF THE INVENTION

1. Field of the Invention

The present invention relates to a chair, in particular an office chair of adjustable height and inclination, consisting of a seat support, a backrest support, a standing column having a first spring element, a support member arranged in horizontal plane on the standing column, first and second guide rods, and at least one second spring element which opposes the swinging back of the seat and backrest supports.

2. Description of Related Art

From EP-A 0 135 875, an inclination mechanism for a seat arrangement which is developed for spring-actuating swinging motion is known which comprises at least one spring element which is arranged in a transverse tube and developed as a torsion rod, which spring element is operatively connected in its central region in a central bearing, arranged fixed in space, at each of its two ends to a rotatable outer bearing and is developed for the automatic return of a swung structural part.

SUMMARY OF THE INVENTION

The object of the present invention is so to develop and improve a chair of the aforementioned type that, while retaining the ergonometric requirements which depend on the user, no transverse forces are transmitted, in particular upon the swinging movement, to the spring element which compensates for the swinging movement and that, furthermore, an adjustment of the initial tension which is dependent upon the weight of the user can be effected.

This object is achieved, in accordance with the invention, in the manner that the two struts of the second guide rod are arranged swingable around a horizontal axis on the support member, that each of them is functionally connected to a transmission mechanism suitably arranged in the support member, and that the swinging movement of the struts can be transmitted on the one hand by the transmission mechanism synchronously to the second spring element which is arranged spaced from the axis of the support member and, on the other hand, via a torsion rod which connects the two transmission mechanisms to each other and via a tensioning device which is operatively connected with the torsion rod, to the first spring element which is arranged in the standing column.

Other features of the invention will become evident from the following description, read in conjunction with the drawing and from the individual claims.

DESCRIPTION OF THE DRAWINGS

The invention will be described in further detail with reference to the drawing, in which.

FIG. 3 shows the part of the supporting frame on a larger scale in side view;

FIG. 7 shows the upper region, shown in cross section, of the standing column provided with the support member.

DETAILED DESCRIPTION OF THE PREFERRED EMBODIMENTS

Figure 1:
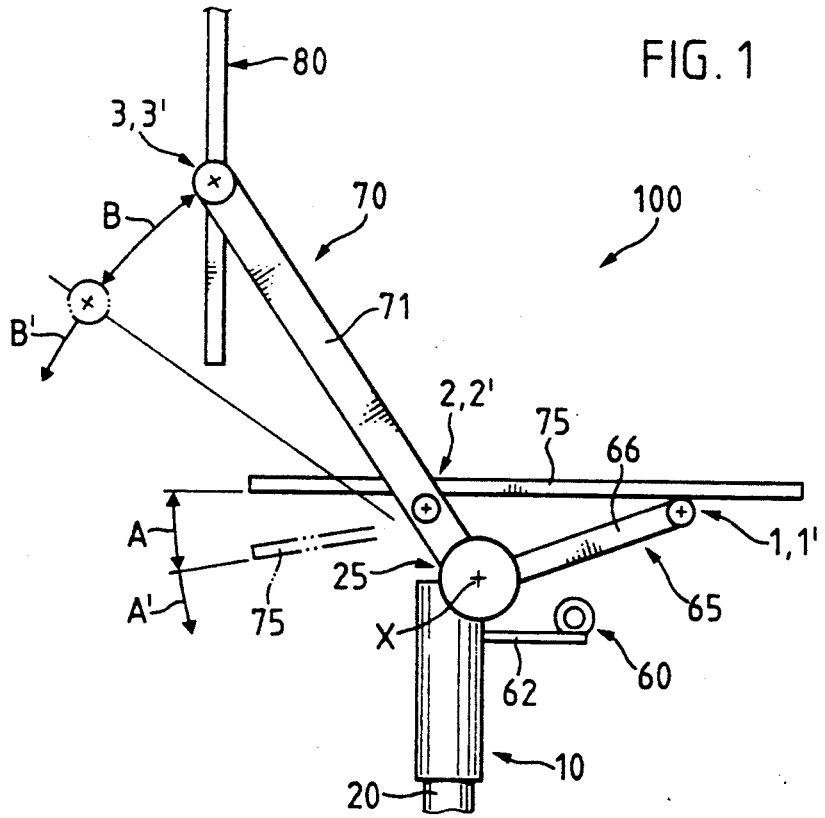
FIG. 1 shows a part of the supporting frame, shown in diagrammatic side view, for a chair provided with a standing column.
Figure 5:
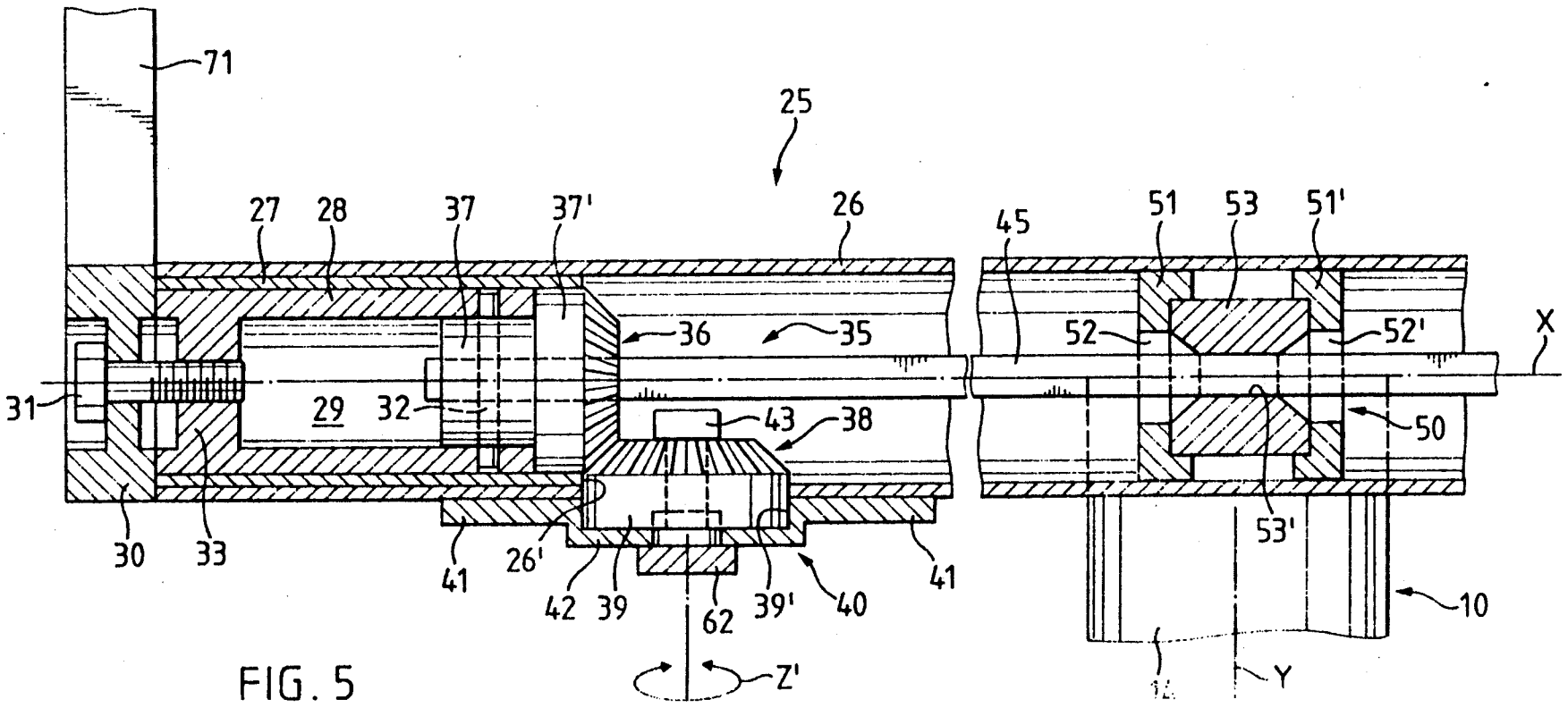
FIG. 5 shows, in cross section, the support member for the chair of FIG. 1.
Figure 6:
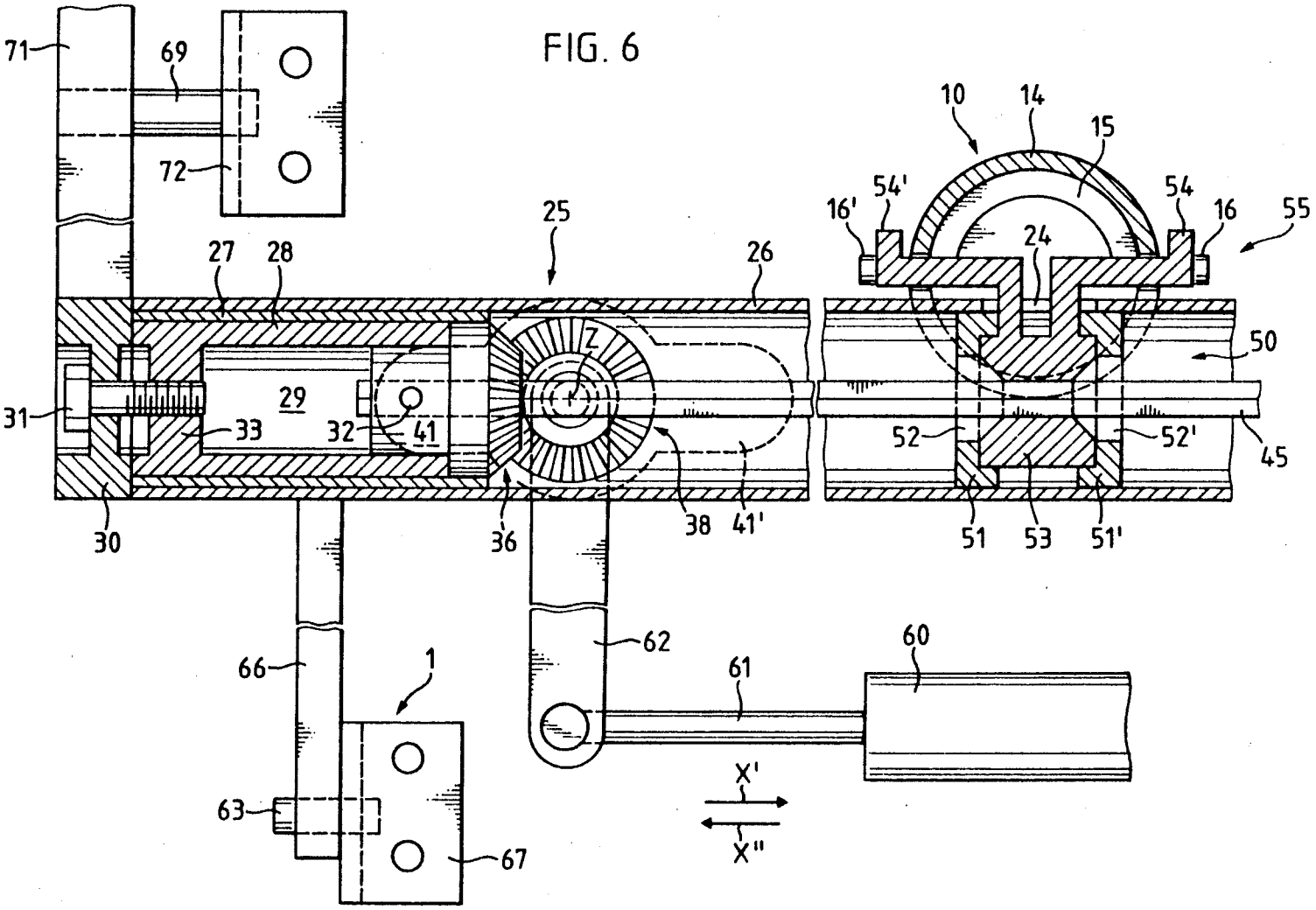
FIG. 6 is a sectional top view of the support member of FIG. 5.

FIG. 1 shows in diagrammatic side view a support-frame part, designated generally as 100, for a chair, and one can note the upper part of an approximately vertically oriented standing column 10, a support member 25 arranged thereon, a first guide rod 65, a seat support 75 for a seat member (not shown), a second guide rod 70 and a backrest support 80 arranged thereon for a backrest, not shown in detail. Within the standing column 10 there is arranged a first spring element 20, developed preferably as a gas spring, which is intended for adjusting the height of the seat support 75. Spaced from and parallel to the support member 25, a second spring element 60 is arranged below the seat support 75. The second spring element 60, which is also developed as a gas spring, is functionally connected via levers 62 suitably pivoted thereon to a transmission mechanism, arranged in the support member 25 (FIGS. 5, 6). The mechanism, which is functionally connected to the second guide rod 70 and transmits substantially the movement of inclination of the parts 75, 80 to the spring element 60, will be described in detail later in connection with FIGS. 5 and 6.

On the other end (not shown) of the standing column 10, there is arranged, for instance, a foot stand (not shown) developed as a so-called five-star rotary lower part by means of which the chair is supported, in a manner not shown in detail, either stationary or else movable on suitably arranged casters on the floor.

Figure 2:
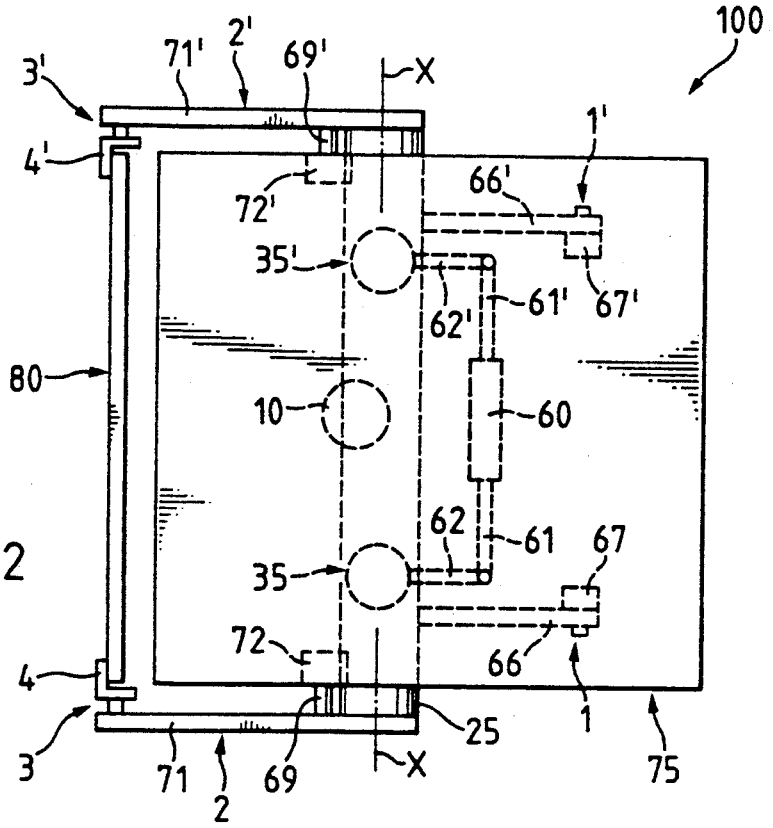
FIG. 2 shows the part of the supporting frame for the chair of FIG. 1, shown in top view.

The first guide rod 65, as shown in top view in FIG. 2, has two struts 66 and 66' spaced apart from each other. Each of the two struts 66, 66' is fastened at one end to the support member 25, in a manner not shown in detail. The other end of the struts 66, 66' is developed as a joint 1, 1'. The joints 1, 1', each provided with a suitably developed bearing pedestal 67, 67', are developed for the supporting and fastening of the seat support 75 on the knee side.

The second guide rod 70, as shown in top view in FIG. 2, has two struts 71 and 71' spaced apart from each other. The two struts 71, 71' have one end arranged and mounted to the side on the support member 25. Each of the other ends of the struts 71, 71' is provided with a joint 3, 3' which is developed in a manner corresponding to the mounting of the backrest support 80. The joint 3, 3' furthermore has a holding part 4, 4' developed suitably to receive and fasten the backrest support 80. Spaced from the corresponding joints 3 and 3', another joint 2, 2' is arranged on each strut 71, 71'. The joints 2, 2', which are each provided with a suitably developed bearing pedestal 72, 72', are also developed for the mounting of the seat support 75 and spaced from the joints 1 and 1'.

The second guide rod 70 with the backrest support 80 arranged thereon is swingable, as shown in FIG. 1, under corresponding load in the direction of the arrow B' around a substantially horizontally oriented axis X of the support member 25. Upon this swinging motion, the seat support 75, which is mounted on the joints 1, 1' and 2, 2', is simultaneously moved in the direction indicated by the arrow A' (FIG. 1).

It may be mentioned here that FIGS. 1 and 2 show merely one embodiment of a seat arrangement which comprises essentially the seat support 75, the backrest support 80, as well as the two correspondingly pivoted guide rods 65 and 70.

The seat arrangement can, for instance, also be developed as shell or the like and, in addition, be provided with side armrests. However, it is essential in this connection for the seat support, together with the backrest support, to be adjustable synchronously with regard to their inclination and that, as shown diagrammatically in FIG. 1, the angle of swing A of the seat support be in a given relationship to the angle of swing B of the backrest support 80.

The ratio of the angles of swings is about 1:2, the angle A being on the order of magnitude of between 10° to 15° and the angle B on the order of magnitude of between 20° and 30°.

FIG. 3 shows the support frame part 100 on a larger scale in side view, and one can note the upper part of the standing column 10, the support member 25 arranged thereon, the first and second guide rods 65 and 70, the seat support 75, the backrest support 80 and the spring element 60 arranged spaced from and parallel to the support member 25.

The bearing pedestal 67 is arranged on the seat support 75 in the front, knee-side region and is fastened by means not shown in detail to the bottom 75' of the seat support 75, for instance by screws. A strap 68 is pivoted by a first bolt 63 to the bearing pedestal 67, the strut 66 of the first guide rod 65 being articulated to said strap by means of a second bolt 64. The parts 67, 68 and 63, 64 together form the joint 1. The other joint 1' with the corresponding parts 67', 68' and 63', 64' is of similar development.

The two joints 1, 1', which are arranged on the knee-side with the correspondingly articulated straps 68, 68', serve, when load is applied to the seat support 75, as necessary length compensation between the joints 1, 1' and 2, 2' which are arranged correspondingly spaced from each other.

The bearing pedestal 72 is arranged and fastened by means, not shown in detail, for instance by screws, on the bottom 75' of the seat support 75 at a distance from the front bearing pedestal 67 arranged on the knee side. A bolt 69 is arranged and mounted in the bearing pedestal 72, the strut 71 of the second guide rod 70 being pivoted on said bolt. The parts 72 and 69 together form the joint 2, the other joint 2' with the corresponding parts 72' and 69' being of similar development.

FIG. 7 shows, in sectional view, a part of the standing column 10, and one can note an upper standing tube 14, the support member 25 which has its tubular body 26 arranged thereon, together with the struts 66 and 71, as well as a torsion rod 45 which is arranged co-axially in the tubular body 26.

The stand tube 14, which is provided in its upper region with two slots 17, 17' arranged opposite each other, is provided on the side facing the tubular body 26 with a recess which is developed in accordance with the outside diameter of the tubular body 26, within which recess the tubular body 26 is mounted and fastened by means not shown in detail. On the side opposite the tubular body 26, the stand tube 14 has a corresponding semi-circular rib 14'.

Within the stand tube 14 there is arranged a slide bushing 15 having a passage bore 15'. In the upper region of the slide bushing 15 there are provided two bolts 16, 16' arranged opposite each other, they being fastened in the wall of the slide bushing in a manner not shown in detail. By means of the two bolts 16, 16' mounted in the slots 17, 17' of the stand tube 14, the slide bushing 15 is functionally connected to the stand tube 14. In the passage bore 15' of the slide bushing 14, there is arranged a push tube 13 which is functionally connected with the spring element 20 arranged therein.

Figure 4:
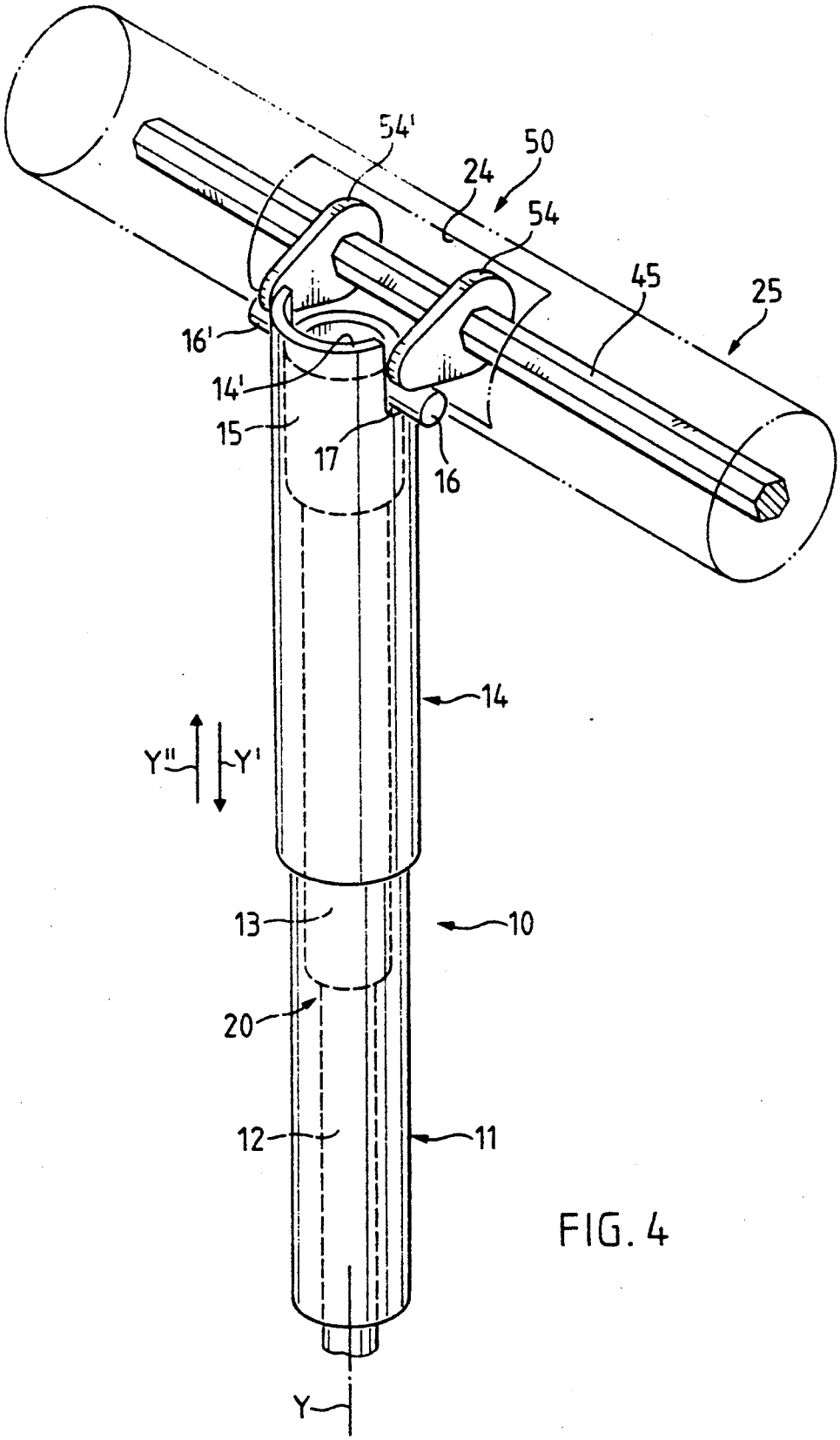
FIG. 4 shows the standing column, shown in perspective view, with a support member suitably arranged thereon.

FIG. 4 shows, in a diagrammatic perspective view, the stand column, designated generally as 10, together with the upper stand tube 14 and a lower stand tube 11. The push tube 13, which is functionally connected with the spring element 20, developed preferably as gas spring, is arranged in the two stand tubes 11, 14. 12 is the piston rod of the gas spring 20. There can also be noted the support member 25 which is arranged in the upper region on the stand tube 14 and has the torsion rod 45 arranged co-axially therein.

Within the support member 25 there is also arranged a tensioning device 50, shown diagrammatically here, which comprises essentially two tensioning levers 54, 54' which are spaced apart from each other and functionally connected to the torsion rod 45. The two tensioning levers 54, 54' pass approximately radially through a cutout 24 provided in the tube member 26 and correspondingly developed and are supported on the two correspondingly associated bolts 16, 16' of the slide bushing 15 which is arranged in the stand tube 14.

The relative movement of the upper stand tube 14 with respect to the lower stand tube 11 is indicated by the arrow directions Y' and Y'', Y' being the movement of loading directed against the restoring force of the gas spring 20, and Y'' the movement of release obtained by the restoring force of the gas spring 20.

FIG. 5 shows in sectional view and FIG. 6 in a top cross section a part of the support member, designated generally as 25, and one can note the tubular body 26 with the strut 71 arranged and mounted on the one end with the bearing pedestal 72 and bolts 69 of the second guide rod 70, as well as the strut 66 with the bearing pedestal 67 and bolt 63 of the first guide rod 65. The struts 71' and 66' are arranged respectively on the other end (not shown in detail) of the tube body 26 (FIG. 2).

The tube body 26 forms the substantially horizontally oriented axis X around which the second guide 70, formed from the two struts 71, 71' is swingable, as shown in FIG. 1, in the direction indicated by the arrow X'. Each of the two struts 71, 71' is functionally connected to the transmission mechanism 35, 35' (FIG. 2) arranged in the end region of the tube body 26, only the one transmission mechanism 35 being shown in FIG. 5.

Furthermore, there can be noted, seen in axial direction, the upper stand tube 14 of the stand column 10, which tube is arranged in the center of the support member 25 on the tube body 26, as well as the tensioning device 50 arranged in the tube body 26. The two transmission mechanisms 35, 35' arranged in the end region of the tube body 26, as well as the tensioning device 50, are functionally connected to each other via the correspondingly developed torsion rod 45, which passes axially through the tubular body 26. The stand column 10 with the vertical axis Y forms substantially an axis of symmetry of the entire support member 25.

As example, the one transmission mechanism 35 arranged in the support member 25 is described below, in conjunction with FIGS. 5 and 6.

Within the tube body 26 there is arranged a bearing sleeve or inner sleeve 27 in which a coupling piece 28 developed in the manner of a bushing, is co-axially supported. The coupling piece 28 is provided with a cutout 29 developed as a blind hole within which a first bevel gear 36 provided with a correspondingly developed cylindrical part 37 is arranged and mounted. A second, cylindrical part 37' of the bevel gear 36 is arranged and mounted in the inner sleeve 27. The bevel gear 36 is functionally connected, fixed for rotation, with the coupling piece 28 by a clamping pin 32 or the like which passes through the corresponding parts. The coupling piece 28 is provided on the side facing the strut 71 with a wall 33 which serves as rest and attachment part for the strut 71 which is provided with a correspondingly developed flange piece 30. In the embodiment shown, the flange piece 30 of the strut 71 is functionally connected by a screw 31 to the coupling piece 28. The functional connection of the flange piece 30 arranged on the strut 71 to the coupling piece 28 can, however, also be obtained by other means, for instance by a suitable spur gearing. Furthermore, the correspondingly developed flange piece 30 can also be developed on the strut 71 so that the parts 30, 71 form a unit.

Corresponding to the first bevel gear 36, a second bevel gear 38 is provided the toothing of which (not shown in detail) is in engagement with the toothing of the first bevel gear 36. The second bevel gear 38 is arranged and mounted via a cylindrical part thereof 39 in a holding element 40 provided with a corresponding cutout 39'. The holding element 40 has two flanges 41, 41' which are adapted to the tube body 26 and by which the holding element 40 is fastened on the tube body 26 by a screw connection, not shown.

The bevel gear 38, as well as the wall 42 of the holding element 40, are passed through by a bolt 43 or the like. The bolt 43 is connected, for instance by a wedge connection or the like (not shown), fixed for rotation to the bevel gear 38.

The bolt 43 forms in this connection an axis of rotation Z which is oriented at right angles to the axis of rotation X of the tube body 26 and of the first bevel gear 36, the second bevel gear 38, which is in engagement with the first bevel 36, and the bolt 43 connected with said second bevel gear being turned around said axis of rotation Z upon corresponding swinging of the guide rod 70. On the one end of the bolt 43, a correspondingly developed swing lever 62 is arranged and fastened in a manner not shown in detail. A correspondingly directed movement is transmitted by the lever 62, which is swingable around the axis of rotation Z in the plane approximately in the direction indicated by the arrow Z', as designated in FIG. 6 by the direction of the arrow X', X'', to the piston rod 61 of the second spring element 60 which is preferably developed as gas spring.

The parts 38, 40, 43 and 62 form a structural unit which can be inserted into the tube body 26 through a cutout 26' provided in the tube body 26 and of corresponding development so that the two bevel gears 36 and 38 are in engagement with each other.

It should be pointed out here that the second transmission mechanism 35', which is functionally connected with the strut 71' and arranged within the tube body 26 is arranged on the other end of the support member 25, not shown in detail in FIGS. 5 and 6, it being developed in a manner similar to the transmission mechanism 35 and comprising the individual elements which are correspondingly arranged and act on the spring element 60.

The tensioning device 50, which is furthermore arranged in the support member 25 and is functionally connected to the elements arranged correspondingly in the standing column 10, will now be described.

As shown in FIGS. 5 and 6, two centering pieces 51, 51', which are spaced apart from each other, are arranged in the tube body 26, each of said pieces being provided with a correspondingly developed bore 52, 52'. Between the two centering pieces 51, 51' there is arranged a tensioning element, designated 55 as a whole, which has a hub piece 53 with bore 53' arranged between the two centering pieces 51, 51'. The two tensioning levers 54, 54', which are developed in the manner of an outrigger and are spaced apart from each other, are arranged on the hub piece 53. The two tensioning levers 54 and 54' of the tensioning element 55 pass in radial direction through the tube body 26 provided with the correspondingly developed cutout 24 and are supported on the two bolts 16, 16' of the slide bushing 15.

In FIGS. 5 and 6 there can also be noted the torsion rod 45 which passes in axial direction through the parts 51, 51' and 53 of the tensioning device 50 and has its one end arranged in the bevel gear 36 of the one transmission mechanism 35 and its other end in the bevel gear 36' (not shown) of the other transmission mechanism 35'.

The torsion rod 45 is preferably polygonally developed in its cross-sectional profile, and the bevel gears 36, 36', as well as the hub piece 53, are provided with a cutout (without reference number) developed in accordance with the cross-sectional profile of the torsion rod so that the two bevel gears 36, 36', as well as the hub piece 53 of the tensioning device 50, are functionally connected to each other.

With the angular gears 36, 36' described above, as well as the struts 71, 71' and levers 62, 62' functionally connected therewith, an exact transmission of the swinging motion which depends, inter alia, also on the weight of the user, is transmitted to the second spring element 60 and the instantaneous position of swing of the elements 75, 80 is thereby retained. Furthermore, by means of the torsion rod 45, which is functionally connected to the two angular gears 35, 35', an initial tensioning of the spring element 20 arranged in the standing column 10 is obtained. The two spring elements 20 and 60 are preferably developed as, so-called, known gas springs.

The parallel arrangement of the gas spring 60 with respect to the horizontally directed support member 25 assures a compact arrangement, as well as a substantially linear introduction of the movements. By the linear introduction of the movements, the piston seals in the gas spring are substantially less heavily and more favorably loaded, thus achieving a substantially longer life and period of operation.

I claim:

1. A chair which is of adjustable height and inclination, comprising:

a seat support (75);

a backrest support (80);

a standing column (10) having a first spring element (20);

a support member (25) arranged on the standing column (10) in a horizontal plane, the seat and backrest supports being swingable rearwardly about a horizontal axis (X) of the support member (25);

first guide rod means (65) connecting a front part of the seat support (75) to the support member (25);

at least one second spring element (60) provided at a distance from the horizontal axis (X) so as to oppose rearward swinging of the seat and backrest supports;

second guide rod means (70) including two struts (71, 71') arranged on the support member (25) so as to be swingable about the horizontal axis (X); and two transmission means arranged in the support member (25), a torsion rod (45) connecting the two transmission means and having operatively connected tensioning means (50), each of the struts (71, 71') being operatively connected to a different one of the transmission means (35, 35') so that swinging movement of the struts (71, 71') is transmitted synchronously by the two transmission means (35, 35') to the at least one second spring element (60) and, via the torsion rod (45) and tensioning means (50), to the first spring element (20).

2. The chair of claim 1, wherein each of the transmission means (35, 35') is an angular gearing that includes a first bevel gear (36, 36') and a second bevel gear (38, 38') in engagement therewith, the first bevel gear (36, 36') being connected via a coupling piece (28, 28') fixed for rotation with the associated strut (71, 71') and the second bevel gear (38, 38') being connected via a correspondingly articulated swing lever (62, 62') to the second spring element (60).

3. The chair of claim 2, wherein the at least one second spring element (60) is a gas spring that is spaced from and parallel to the horizontal axis (X) of the support member (25) and is operatively connected at both ends via corresponding piston rods (61, 61') to the swing levers (62, 62') which are actuated by the second bevel gear (38, 38').

4. The chair of claim 2, wherein the second bevel gear (38, 38') is arranged in a housing-like holding element (40) for rotation around an axis (Z) which is directed at right angles to the axis of rotation (X) of the first bevel gear (36, 36') and can be inserted through a cutout (26') provided in a tube body (26) of the support member (25) and brought into engagement with the first bevel gear (36, 36').

5. The chair of claim 4, wherein the second bevel gear (38) is mounted for rotation with a bolt (43) arranged in the holding element (40) around the axis (Z), and the swing lever (62) is functionally connected to the bolt (43), the second bevel gear (38) and the swing lever (62) forming a structural unit that is insertable into the tube body (26).

6. The chair of claim 2, wherein the tensioning means (50) is arranged within a tube body (26) of the support member (25) and comprises a hub piece (53) which is connected, fixed for rotation, to the torsion rod (45) and has two tensioning levers (54, 54') arranged thereon, the tensioning levers (54, 54') being spaced from each other in an axial direction of the tube body (26) and pass through the tube body (26) in a radial direction, and being supported on a slide bushing (15) which is functionally connected to the first spring element (20) arranged in the standing column (10).

7. The chair of claim 6, wherein the two bevel gears (36, 36') are spaced from each other on the horizontal axis (X) of the tube body (26) as well as the hub piece (53), and are provided with a passage opening that corresponds with a cross-sectional profile of the torsion rod (45).

8. The chair of claim 7, wherein the torsion rod (45) has a polygonal cross-section profile.

9. The chair of claim 6, wherein the slide busing (15) comprises two radially outward directed bolts (16, 16'), each guided in a slot (17, 17') of the stand tube (14), against which bolts the two tensioning levers (54, 54') of the tensioning means (50) rest.

10. The chair of claim 6, wherein the hub piece (53) of the tensioning means (50) with the two tensioning levers (54, 54') is arranged by centering pieces (51, 51') arranged corresponding in the tube body (26) corresponding to the vertical axis (Y) of the standing column (10) and held in position.

11. The chair of claim 1, wherein a) the first guide rod means (65) has one end arranged on the support member (25) and is provided on its other knee-side end with a first joint (1, 1') for the mounting of the seat support (75), b) the second guide rod means (70) being functionally connected at one end to the transmission means (35, 35') arranged in the support member (25) and provided on its other end with a second joint (3, 3') for mounting of the backrest support (80), and has a third joint (2, 2') which is provided for mounting of the seat support (75), and c) the seat support (75) and the backrest support (80) being adjustable together in inclination, an angle of swing (A) of the seat support (75) being in a given relationship to an angle of swing (B) of the backrest support (80).

12. The chair of claim 11, wherein between the seat support (75) and the backrest support (80) there is an angle-of-swing ratio of 1:2, the angle of swing (A) of the seat support (75) being on the order of magnitude of between 10° and 15° and the angle of swing (B) of the backrest support being on the order of magnitude of between 20° and 30°.

13. The chair of claim 11, wherein the two joints (1, 1') arranged on the knee side are each provided with a strap (8') which connects the seat support (75) to the struts (66, 66') so as to compensate for length upon relative movement of the seat support (75) with respect to the support member (25).

* * * * *